US006949494B2

(12) United States Patent
Clignet

(10) Patent No.: US 6,949,494 B2
(45) Date of Patent: Sep. 27, 2005

(54) SYNTHETIC DETERGENT FORMULATIONS

(75) Inventor: Paul Clignet, Ougree (BE)

(73) Assignee: Imperial Chemical Industries PLC, London (GB)

( * ) Notice: Subject to any disclaimer, the term of this patent is extended or adjusted under 35 U.S.C. 154(b) by 336 days.

(21) Appl. No.: 10/265,694

(22) Filed: Oct. 8, 2002

(65) Prior Publication Data

US 2003/0114346 A1 Jun. 19, 2003

Related U.S. Application Data

(62) Division of application No. 09/505,793, filed on Feb. 17, 2000, now Pat. No. 6,475,972, which is a continuation of application No. PCT/GB98/02489, filed on Aug. 19, 1998.

(30) Foreign Application Priority Data

Aug. 21, 1997 (GB) ..... 9717723

(51) Int. Cl.[7] ..... C11D 17/00; C11D 11/00

(52) U.S. Cl. ..... 510/156; 510/130; 510/141; 510/151; 510/155; 510/441; 510/447

(58) Field of Search ..... 510/156, 155, 510/153, 152, 130, 441, 159, 151, 447; 424/401, 59; C11D 17/00, 11/00; A61K 7/50

(56) References Cited

U.S. PATENT DOCUMENTS

| | | | | | |
|---|---|---|---|---|---|
| 4,111,853 | A | * | 9/1978 | Shultz et al. | 510/536 |
| 4,405,492 | A | | 9/1983 | Nyquist et al. | |
| 4,612,136 | A | | 9/1986 | Novakovic et al. | |
| 5,154,849 | A | * | 10/1992 | Visscher et al. | 510/150 |
| 5,858,939 | A | * | 1/1999 | Tsaur | 510/141 |

FOREIGN PATENT DOCUMENTS

| | | |
|---|---|---|
| GB | 0 845 376 | 8/1960 |
| GB | 1 294 754 | 11/1972 |
| GB | 2 231 579 | 11/1990 |
| WO | WO 92/16610 | 10/1992 |

* cited by examiner

*Primary Examiner*—Gregory Webb
(74) *Attorney, Agent, or Firm*—Mayer Brown Rowe & Maw LLP

(57) ABSTRACT

Synthetic detergent formulations are made by spray drying an aqueous dispersion or emulsion of a synthetic detergent and a hydrophobic plasticiser and optionally a filler to produce a particulate product. In particular the synthetic detergent includes mild surfactants such a fatty isethionate or sulphosuccinate surfactants. By spray drying the emulsion or dispersion, a particularly uniform product is made which can readily be formed into synthetic detergent bars which may include soap to form combination bar products (combi-bars).

20 Claims, No Drawings

SYNTHETIC DETERGENT FORMULATIONS

CROSS REFERENCE TO RELATED APPLICATIONS

This application is a divisional of U.S. Ser. No. 09/505,793, filed Feb. 17, 2000, now U.S. Pat. No. 6,475,972 which continuation International Application No. PCT/GB98/02489, filed Aug. 19, 1998. These applications, in their entirety, are incorporated herein by reference.

This invention relates to synthetic detergents and in particular to improved methods for the manufacture of products made with synthetic detergents.

In the manufacture of products made with synthetic detergent compounds, in particular the manufacture of bars using synthetic detergents ("syndet bars") and bars containing both synthetic detergents and soaps ("combination" or "combi" bars"), it is known that the compounded detergent formulations are difficult to form into bars. Currently, such bars are made by processes similar to those used for making bars from natural soaps (based on the salts, usually alkali metal salts of naturally occurring fatty acids), in particular by compounding the basic ingredients into flakes or extruded "noodles". Conventionally, these are made by mixing the raw materials using high shear blending of synthetic detergents, and in combi bars with soap(s), with a molten plasticiser in the presence of relatively small amounts of water. The result is a relatively inhomogeneous or macroscopic mixture. The mix is then flaked or extruded to give noodles. The bars are made from the flakes or noodles by working at moderately elevated temperatures using roll mixers an extruders (the processing in extruders is commonly referred to as "plodding"), followed by extrusion to form a slug of the compounded soap mixture which is then cut and pressed into the final bar form. A particular problem in the manufacture of syndet and combi bars is that the temperature range within which the plasticity of the formulation allows slug and bar manufacture is much narrower than is available in the manufacture of bars made from natural soaps. This necessitates relatively tight process control to make slugs and eventually bars which have adequate coherence to be of practical value. Even so, presently available syndet and combi bars are not fully satisfactory as products for domestic use. Further it is difficult to incorporate significant amounts of additives that provide useful properties in the final product as the additives typically cause changes in the plasticity profile of the overall mix sometimes causing softening and sometimes hardening, thus complicating processing.

This invention is based on the discovery that preprocessing a composition containing the synthetic detergent to produce a relatively finely divided powder or granulate can make subsequent processing much simpler, enabling the incorporation of additives more easily and at higher levels than is practical with conventional processing methods, and enabling the manufacture of products, particularly slugs to give cleansing bars which have superior uniformity and give better, particularly smoother, skin feel in use than conventional synthetic detergent cleansing bars.

Accordingly the present invention provides a method of making a formulated synthetic detergent product, which includes:

1. forming an aqueous dispersion or emulsion of a synthetic detergent and a hydrophobic plasticiser and optionally a filler, and
2. spray drying the dispersion or emulsion, to produce a particulate product including the synthetic detergent and the hydrophobic plasticiser, and, optionally, the filler.

The invention includes a detergent material in particulate form which includes a synthetic detergent and a hydrophobic plasticiser and optionally a filler is a substantially homogeneous dispersion. In particular in this aspect of the invention, the detergent material is in particulate form including a synthetic detergent and an hydrophobic plasticiser, and, optionally, a filler, in substantially homogeneous dispersion, having a weight average particle size of from 150 to 1200 $\mu$m, particularly in free flowing non-dusting particulate form.

The invention further includes a method of making bars of synthetic detergent materials which comprises forming a synthetic detergent material in particulate form of or made by the spray drying method of the invention into bars.

The invention additionally includes a personal care synthetic detergent cleansing bar product which has been made from a synthetic detergent material in particulate form of or made by the spray drying method of the invention.

The synthetic detergent is (typically) an anionic or non-ionic surfactant. Suitable anionic types of surfactant include alkyl sulphates, such as lauryl, myristyl, stearyl and cetyl sulphates, alkyl sulphonates, alkyl ether sulphates, alkyl glycerol ether sulphonates, alkyl phosphate esters, ethoxylated alkyl phosphate esters, sarcosinates, taurate derivatives, alkyl sulphoacetates, hydroxyalkyl sulphonate esters, such as isethionate esters, particularly of fatty carboxylic acids, for example cocoyl isethionic acid, lauryl isethionic acid and stearyl isethionic acid, usually used as an alkali metal e.g. sodium salt, alkyl sulphosuccinates, such as di-sodium and/or potassium lauryl, oleyl and stearyl sulphosuccinates, alkyl ether sulphosuccinates, alkyl sulphosuccinamates, and acyl glutamates. Such anionic surfactants are usually used as metal, usually alkali metal especially sodium or potassium, ammonium, ethanolamine or alkali earth metal particularly magnesium salts.

The alkyl chains in such surfactants are typically $C_9$ to $C_{20}$, more usually $C_{14}$ to $C_{18}$ chains. Suitable non-ionic types of surfactant include alkyl polysaccharides (more properly described as alkyl oligosaccharides) particularly where the saccharide residues are glucose residues and particularly where the alkyl groups are $C_8$ to $C_{16}$ alkyl groups, and especially lauryl or decyl glucoside, particularly having an average degree of polymerisation of from 1 to 2; sorbitan ester alkoxylates, particularly sorbitan laurate or stearate ethoxylates e.g. containing an average of from about 15 to about 30, particularly an average of about 20, ethylene oxide residues per molecule; glucamide surfactants such as glucamides of $C_8$ to $C_{22}$ acids; alcohol alkoxylate, particularly ethoxylate surfactants, especially $C_{10}$ to $C_{22}$ alkyl alkoxylates, particularly ethoxylates, typically containing 20 to 100 alkoxylate, particularly ethoxylate, residues; carboxylic acid ethoxylates especially of $C_{10}$ to $C_{22}$ carboxylic acids and containing 20 to 100 ethoxylate residues. The composition may also include ester surfactants such as glycerol mono-esters such as glyceryl mono-stearate, oleate or laurate, and citrate esters.

As is usual in personal care products, it is desirable to include mild surfactants. And it is for this reason that anionic surfactants where the hydrophile is the anionic residue of a relatively strong acid group, usually a sulphate or more usually a sulphonate group, are used in this invention. Typical examples of such surfactants include carboxylic acids including fatty, particularly $C_8$ to 20 alkyl, esterified with hydroxyalkylsulphonic acids such as isethionic acid (2-hydroxyethane sulphonic acid; $HO.CH_2.CH_2.SO_3H$), as salts, usually alkali metal salts, particularly sodium salts of $C_{12}$ to $C_{20}$ carboxylic isethionates, especially sodium cocoylisethionate and sulphosuccinate surfactants. Combinations of isethionate surfactants and sulphosuccinate surfactants, for example approximately equal proportions of sodium cocoyl isethionate and sodium sulphosuccinate, give particularly good results. Such mild surfactants can be used alone or in combination with other (more harsh) surfactants, but such mixtures will have intermediate mildness properties.

The use of such mild surfactants is an important feature of the invention such that it forms a specific part of the invention which accordingly includes a method of making a formulated synthetic detergent product, which comprises 1 forming an aqueous dispersion or emulsion of a surfactant composition comprising at leastone fatty isethionate foaming surfactant, optionally but desirably at least one sulphosuccinate salt; a hydrophobic plasticiser; and optionally a filler; and 2 spray drying the dispersion or emulsion, to produce a particulate product including the synthetic detergent and the hydrophobic plasticiser, and, optionally, the filler.

In such mild surfactant based products, the surfactant is desirably mainly or predominantly a mild surfactant, in particular, at least 50%, desirably at least 75% and especially at least 90%, by weight of the surfactant is a mild surfactant, particularly an alkyl sulphonate and/or a sulphosuccinate and/or a fatty isethionate. This forms a further specific aspect of the invention.

Other surfactants, particularly synthetic surfactants can be included in the synthetic detergent products of and made by the present invention. Suitable synthetic surfactants include amphoteric surfactants such as betaine derivatives, imidazoline derivatives, and fatty amphoacetates, particularly coco-amphoacetates. The composition may also include soaps, particularly fatty acid soaps, particularly alkali metal salt of fatty $C_{12}$ to $C_{20}$ carboxylic acids such as sodium and/or potassium stearate and/or myristate and/or cocoate. The amount of fatty acid soaps, when used, can vary widely. Relatively small amounts can be used to improve the cosmetic properties of syndet formulations such as foaming. In such applications the amount will usually be from 5 to 30% by weight based on the total amount of detergent in the composition. These levels are typical of some commercial combi-bar formulations. At such levels the soap may substitute for part of or add to the synthetic detergent in the formulation. Compositions containing relatively large amounts of soap can be considered as soap based compositoins which include syndets to make them more mild or to make the base more compatible with additives. In such systems, the soap can be up to about 95%, typically 75 to 95%, by weight based on the total amount of detergent in the composition. Levels intermediate these ranges are used in combination formulations intended to have properties intermediate those of syndets and soaps. For such products the amount of soap is usually in the range 30 to 75%, more usually 40 to 60%, by weight based on the total amounts of detergent in the composition.

When fatty acid soaps are included in the compositions, the manufacturing process for the bar products can involve including part or all of the soap in the emulsion which is spray dried, combining soap e.g. in the form of conventional noodles, flakes or pellets, with spray dried syndet powder or a combination of these.

The component described generally as a hydrophobic plasticiser serves the function of softening the detergent product to improve its workability, particularly in the manufacture of detergent bars. The manufacture of detergent bars is typically carried out at temperatures of from 35 to 50° C. and the hydrophobic plasticisers used in the invention typically have melting or softening points from ambient temperature up to about 90° C., desirably up to 50° C. Suitable materials include fatty acids, particularly $C_{12}$ to $C_{22}$ fatty acids such as stearic, myristic and coconut oil fatty acids; fatty alcohols, particularly $C_{14}$ to $C_{22}$ fatty alcohols such as stearyl alcohol; waxes such as paraffin wax or hydrogenated oils such as hydrogenated castor oil and jojoba wax (hydrogenated jojoba oil).

The filler is an optional but very desirable component of the detergent formulation used in the invention. It is a relatively inert finely divided particulate material, usually having an average particle size of less than 50 $\mu$m, typically from 2 to 25 $\mu$m which provides binding, additional plasticity and improved skinfeel properties. The filler can be an organic material such as starch or an inorganic material such as talc.

The relative (percentage) proportions by weight of the detergent and the hydrophobic plasticiser are usually as follows:

| Material | broad range | usual range |
|---|---|---|
| detergent | 55–80 | 60–75 |
| hydrophobic plasticiser | 45–20 | 40–25 |

When the filler present the relative proportions of the detergent and the hydrophobic plasticiser are generally within the above ranges and the filler is added as from 2 to 25. particularly 8 to 22 are especially 10 to 20% of the three component system. This gives three component percentage compositions by weight typically as follows (including for clarity the no-filler proportions):

| | | broad range | | | | usual range | | | |
|---|---|---|---|---|---|---|---|---|---|
| | amount | detergent | | hydrophobic plasticiser | | detergent | | hydrophobic plasticiser | |
| Filler range | (%) 0 | from 80 | to 55 | from 20 | to 45 | from 60 | to 75 | from 40 | to 25 |
| broad | 5 | 76 | 52 | 19 | 43 | 57 | 71 | 38 | 24 |
| | 25 | 60 | 41 | 15 | 34 | 45 | 56 | 30 | 19 |
| usual | 8 | 73.5 | 50.5 | 18.5 | 41.5 | 55 | 69 | 37 | 23 |
| | 22 | 62.5 | 43 | 15.5 | 35 | 47 | 58.5 | 31 | 19.5 |
| pre- | 10 | 72 | 49.5 | 18 | 40.5 | 54 | 67.5 | 36 | 22.5 |
| ferred | 20 | 64 | 44 | 16 | 36 | 48 | 60 | 32 | 20 |

Other components such as are conventionally included in syndet and combi bars can be included for example polymers such as high molecular weight polyethylene glycol (PEG). typically having a molecular weight of greater than 100 kD and polysaccharides which improve binding, skinfeel and compatibility, conditioners such as polyquaternary ammonium compounds (polyquats) humectants such as glycerol and sorbitol ethoxylates such as sorbeth-30, emollient oils such as mineral oils e.g. isoparaffin oils, natural or synthetic triglycerides, propoxylates alkyl ethers, perfumes, pigments and dyes. Such materials will usually be included in conventional concentrations, for each type of these components typically from 0.1 to 5% by weight of the overall formulation. Depending on their nature, they can be included at any suitable stage in manufacture, by inclusion in the emulsion (for non-volatile components), by addition to the spray dried product or by inclusion at later stages of processing.

The dispersion or emulsion in water can be made up by simply dispersing the individual components, detergent(s), hydrophobic plasticiser and optionally filler in water and warming the mixture to form the dispersion or emulsion. However, it is generally desirably to preheat the water to about or above the melting temperature of the hydrophobic plasticiser, a typical range is from about 75 to about 90° C., then to add the filler (if used) followed by the detergents and finally to add the hydrophobic plasticiser in liquid (molten) form and to stir the mixture. Generally high shear mixing is not needed to disperse or emulsify the components once the mixture has been made up. This makes the processing relatively simple and straightforward. The dispersion or emulsion is then spray dried typically by feeding the dispersion or emulsion to a spray drier using a heated stream of gas, typically air or nitrogen, usually as dry gas as the drying medium. The temperature of the dry gas will be high enough, and sufficiently above the dew point of the gas, to enable efficient removal of water i.e. to supply enough heat to evaporate the water present t the flow rates used, but not so high that it causes decomposition of the product. Typically, the dry gas temperature will be from 160 to 250° C.

After spray drying the powdered detergent composition can be subject to mild agglomeration e.g. in a fluidized bed, particularly with the recirculation of fines, particularly to reduce the proportion of fines and modestly to increase the average particle size. This aggregation reduces dusting and eases the incorporation of additives. The weight average particle size of the spray dried detergent product is generally in the range from 50 to 1200 $\mu$m. More usually, if the powder is not agglomerated, the weight average particle size is typically from 50 to 250 $\mu$m and if it is agglomerated, the weight average particle size (after agglomeration) is typically from about 200 to about 750 $\mu$m.

Bars can be made from the spray dried powder straightforwardly using conventional techniques (allowing for the form of the feedstock). Thus the powder can be charged to a mixer and appropriate amounts of water, perfume and other additives, if desired, such as oils, humectants e.g. glycerine, and plant extracts and be added and the composition mixed until the components are uniformly distributed. We have found that this can be more quickly than with detergents in the form of flakes or noodles. Thus, with the product produced according to the invention, mixing can be done in about 1 minute, where with flakes or noodles it would take 3 to 4 minutes. This can significantly enhance the output of the mixers without requiring investment in larger scale equipment. Further, because extended mixing increases the extent to which the compositions become soft and sticky, the ability to operate with short mixing times is an additional benefit.

The mixture is then passed to a bar making line where it can be milled in a 2 or 3-roll mill to give a sheet with the desired plasticity and temperature and then processed in a simplex extruder (usually fitted with a coarse grid) to extrude the slug of soap. In the conventional manufacture of syndet and combi bars, the milling step, particularly during start up, usually involves much adjustment of the set up to make a satisfactory product. We have found that using the spray dried product made by this invention, the set up of the milling stage is made much easier. Alternatively, the processing on the 2/3-roll mixer can be omitted and the mixture passed directly to a plodder e.g. a duplex (2-step) plodder, and the soap bare extruded. The route chosen will depend on the desired degree of homogeneity in the product. The extruded slug can then be cut and stamped to form the soap bar product.

Using the spray dried material of this invention, we have found that after mixing, as described above, the product can be passed directly to the plodder or extruder. This contrasts with manufacture using conventional flakes or noodles because these materials usually require processing in a simplex extruder or plodder and/or roll-mill to homogenise the product and give it a suitable plasticity before further plodding and bar extrusion. We have further found that the time needed for a processing line to settle to steady state operating conditions is much shorter using the spray dried material according to this invention. We believe that this is because the spray dried material provides better filling of the volume of the extruder and improved surface contact and higher internal friction of the material being extruded leads to a much quicker equilibration the temperature.

It is an advantage of this invention that the generally adverse effects on processability (in bar making) of mixer additives is much less than in conventional processes. Thus, much higher amounts of water can be included before the material becomes too soft to process. For example, using conventional flakes noodles or pellets, the maximum amount of water that can be added is typically from 2 to 4%, but using powder made according to the invention amounts as high as to 10 to 13% can be added without major difficulty. Also, additives, such as perfumes, particularly alcohol or hydroalcohol based perfumes, that have an adverse effect on plasticity and binding in conventional systems sometimes making it impossible to extrude the detergent as a slug, have much reduced impact on the process carried out using the spray dried product according to this invention.

The invention includes a method of making a synthetic detergent bar which includes the steps of:

1. forming an aqueous dispersion or emulsion of a synthetic detergent and a hydrophobic plasticiser and optionally a filler; and
2. spray drying the dispersion or emulsion, to produce a particulate product including the synthetic detergent and the hydrophobic plasticiser, and, optionally, the filler;

and subsequently forming the particulate product including the synthetic detergent into a bar.

In particular the synthetic detergent bar can be made by mixing optional further component is (if any) with the particulate product including the synthetic detergent followed by milling in a 2 or 3-roll mill and subsequent processing in a simplex extruder (usually fitted with a coarse grid) to extrude the slug of soap which is subsequently cut and stamped into bars. Alternatively, the processing on the 2/3-roll mixer can be omitted and the mixture passed directly to a plodder e.g. a duplex (2-step) plodder, and the soap extruded as a slug which is subsequently cut and stamped into bars.

The following Examples illustrate the invention. All parts and percentages are by weight unless otherwise stated.

| Materials Used | |
|---|---|
| Arlatone SCI | sodium cocoyl isethionate ex ICI Surfactants |
| Radiasurf 7140/3 | glycerol mono stearate ex Oleofina |
| Radiacid 0427 | stearic acid ex Oleofina |
| Talc de Luzenac | finely divided talc as filler ex Luzenac |
| Perfumes | Blue Water hydroalcoholic perfume ex Dragoco |
| Zetasap 813A | syndet base ex Zschimmer & Schwarz containing: 50% (w/w) anionic surfactant: disodium C12 to C18 sulfosuccinate and sodium alcohol |

-continued

| Materials Used | |
|---|---|
| | C12 to C18 sulfate<br>23% fillers<br>including corn starch<br>23% plasticizers<br>including cetearyl alcohol and paraffin<br>3.5% water<br>0.1% Titanium dioxide<br>white to ivory-coloured noodle-shaped pellets. |
| Zetasap 5165 | syndet base ex Zschimmer & Schwarz containing:<br>40% (w/w) anionic surfactant:<br>disodium C12 to C18 sulfosuccinate and sodium cocoyl isethionate<br>26% fillers<br>including corn starch<br>30% plasticizers<br>including cetearyl alcohol glyceryl stearate and paraffin<br>3.5% water<br>0.1% Titanium dioxide<br>white to ivory-coloured noodle-shaped pellets. |
| Tensianol LSA-LM | syndet base ex ICI Surfactants which contains:<br>43% anionic surfactants<br>disodium lauryl sulphosuccinate and sodium cocoyl isethionate<br>20% refattening oil phase<br>cetearyl alcohol and hydrogenated castor oil<br>20% corn starch<br>and minor amounts of cocamidopropyl betaine, glycerine, mineral oil, titanium dioxide, and water |

The commercial syndet base materials are manufactured by blending the base components at relatively low water content (less than 50% of the total composition) and evaporative drying followed by extrusion as noodles, flaking or pelletting. Those skilled in the art recognise that such products, particularly those in noodle or pellet form require high shear processing, typically using a roll mill to give the product the acceptable plasticity and surface to accept additives before it is extruded as bars. Without this sort of processing, the product does not extrude successfully.

EXAMPLE 1

A synthetic detergent formulation was made up containing the following components:

| material | weight % | role |
|---|---|---|
| Arlatone SCI | 14.28 | surfactant |
| Radiasurf 7140/3 | 11.22 | hydrophobic plasticiser |
| Radiacid 0427 | 2.0 | |
| Talc de Luzenac | 1.5 | filler |
| water | 70 | dispersion medium |

The dispersion was made by heating the water to 80° C. and dispersing the Arlatone SCI under moderate stirring until homogeneous. The Radiasurf 7140/3 and Radiacid 0427 were heated to 80° C. and added to the aqueous mix under stirring until it was homogeneously dispersed. The dispersed mix was held at 80° C. under moderate stirring until further processing by spray dying. The resulting emulsion was spray dried using a NIRO pilot dryer P63 at an evaporation rate in the range 10 to 60 kg water. hour$^{-1}$. The spray drying was carried out under the following conditions: temperatures: slurry at spray drier inlet 75° C.; drying chamber inlet (using hot air as the drying medium) 195 to 200° C.; outlet 90° C.; air flow 400 m$^3$.hour$^{-1}$. The resulting powder had an average particle size of less than 200 $\mu$m and a water content of 3%.

This material was converted into bars using a pilot single screw extruder at ambient temperature. Adding 10% of water did not adversely influence the plasticity of the slug or the hardness f the resulting cleansing bars.

EXAMPLE 2

A spray dried product similar to that of Example 1 was made by spray drying an aqueous emulsion formed by dispersing Zetasap 813A at 30% in water preheated to 80° C. with moderate stirring. This temperature is above the melting temperature of the blend of the hydrophobic plasticiser components of the syndet formulation. The resulting emulsion was spray dried using a NIRO pilot dryer P63 at an evaporation rate in the range 10 to 60 kg water.hour$^{-1}$. The spray drying was carried out under the following conditions: temperatures: slurry at spray drier inlet 75° C.; drying chamber inlet (using hot air as the drying medium) 195 to 200° C.; outlet 90° C.; air flow 400 m$^3$.hour$^{-1}$. The resulting powder had an average particle size of less than 200 $\mu$m and a water content of 2.5%.

EXAMPLE 3

Example 2 was repeated except that Zetasap 5165 was used instead of the Zetasap 813A used in Example 2. The resulting powder had a water content of 2.5% (the original Zetasap 5165 has a water content of between 4 and 7%) by weight.

The resulting powder, which was very similar in physical form to that of Example 2, was converted directly at ambient temperature in a simple single screw pilot scale laboratory extruder with addition of 10 to 15% of water into syndet slugs which can be stamped into bars without making the extruded slug or stamped bars soft. In contrast, the commercial flake material needs to be roll-milled or heated to 40° C. and recycled many times in the extruder to mimic the roll-mill plasticising step and to allow incorporation of the water/glycerin processing additives (2.5%).

The powder syndet material (heated or at ambient temperature) was mixed with the additives and water/glycerin process aids until homogeneous, adding material to the extruder gradually and extruding it into noodles using a 4 mm diameter grid at the extrusion head. The body of the extruder was cooled at this stage to avoid slipping. The syndet noodles were subsequently passed through the extruder a second time to mimic the sequential use of simplex and duplex extruders. For the second pass a heated extruder head was used to make a rectangular (cross section) slug. After extrusion, the slug was cut and stamped into bars.

EXAMPLE 4

Tensianol LSA-LM flake syndet base was dispersed at 30% by weight in water at 80° C. and under moderate stirring. This temperature is above the melting temperature of the hydrophobic plasticiser components of the syndet formulation and enables it to be emulsified in the surfactant solution formed on dispersion. Subsequently, 2000 l of this emulsion was spray dried in a Niro MSD spray drier having a water removal capacity of about 1000 kg water.hour$^{-1}$. A vibrating fluidised bed and filter were placed at the bottom of the dryer to granulate the spray dried material and to separate and recirculate small particles to the dryer. Hot air was used as the drying medium and the drying chamber inlet temperature was 180° C., the drying chamber outlet temperature was 65° C. an the airflow temperature in the fluidised bed was 75 to 85° C. The resulting free flowing dust free powder had a particle size of between 300 and 1200 μm and a water content of 2.5% (Tensianol LSA-LM flake has a water content between 2 and 6%) by weight.

This powder product was further processed on an industrial line. In comparison with the original flake form of the syndet, the mixing time reduced by 50% and the absorption capacity of the syndet was increased. Thus using 100 kg of powder, 8 kg water, 3 kg of an hydroalcoholic perfume and 1 kg almond oil were added and all these additives were readily absorbed. This was accomplished without an adverse effect on the end properties of the syndet bar products. It is well understood in the art that this cannot be achieved using conventional flake, noodle or pellet materials.

We found that it was not necessary to use a roll mill to process the powdered syndet, some of the powder was processed using a roll mill to see whether the processabilty of the powder in roll mill was satisfactory. (This allows for the practical situation where a bar manufacturer has a roll mill in the production line and it would be inconvenient to remove it just to process powdered syndet material.) The powdered syndet was processed through a roll mill without difficulties or further readjustment.

Generally it is well understood in the art that it is not practical to operate so simply using conventional flake, noodle or pellet syndets. Using flakes, noodles or pellets, it is usually necessary to heat the roll mills on start up and to use a relatively wide gap between the rolls to avoid the roll mill blocking. After start up, the roll mill gaps needs to be narrowed so to enable the syndet to be processed to give the desired plasticity and to avoid leaving hard fragments in the milled syndet. Further, frictional heating means that the roll mill need to be cooled to avoid sticking and blockage. All this needs careful handling and coordination until steady state operating conditions are reached.

The product was evaluated in use by skilled personnel and the touch and skinfeel of bar made from the powdered syndet was judged to be much better than otherwise similar bars made from conventional flaked syndet.

EXAMPLE 5

It is well known that perfumes, especially alcohol and in some cases hydroalcoholic based perfumes tend to change the binding and plasticity properties of syndet bases. The following tests show the superiority of the material made according to the invention compared with flaked material. The powdered syndet made as described above, was converted into bars using a simple—single screw pilot extruder Example 5a and 5b samples). Samples of the same syndet formulation but in the form of flakes (as supplied) were also converted into bars on the same equipment (Comparative Example C5a and C5b samples). In one test, ethanol was used as an additive to simulate an alcohol based perfume and in the other Blue Water perfume was used.

The syndet material (heated or at ambient temperature) was mixed with the additives and process aids and supplied to the extruder and extruded in noodles using a 4 mm diameter grid at the extrusion head. The amount (percentage based on the detergent composition weight) of water that could be added during mixing to improve processing without it becoming sticky was noted and is given as Water % in Table 1. For the powdered material it was satisfactory to use an inlet temperature of 22° C., but for the flaked material it was necessary to warm it so that the temperature of the material at the inlet was 40° C. to enable satisfactory processing through the extruder. (The body of the extruder was cooled at this stage to avoid slipping.) The plasticity of the extra ed noodles was assessed and is indicated in Table 1 as Noodle plasticity. The material was subsequently passed through the extruder a second time to mimic the sequential use of simplex and duplex extruders on a full scale production line and a heated extrusion head was used to make a rectangular (cross section) slug which, after extrusion, was cut and stamped into bars. If this did not give a mix with adequate plasticity for processing into bars, the mix was again processed through the extruder making three passes in all. In Table 1 the number of Passes=1 indicates that satisfactory plasticity was achieved after 1 extruder pass starting from extruded noodles and Passes=2+indicates that 2 passes were needed—not always giving a fully satisfactory result even then. The appearance and binding of the extruded slug were noted and are included briefly in Table 1. Binding= "poor" means that the cooled and matured bar breaks under low stress and "good" means it meets standard specification, breaks under high stress. Good plasticity is necessary to be able to stamp bars from the extruded slug at an economical rate and to obtain bars that do not "open" or "crack" when cooling.

TABLE 1

| Sample | C5a | 5a | C5b | 5b |
|---|---|---|---|---|
| Additives-Material-Amount (%) | ethanol 3 | ethanol 5 | Blue Water 3 | Blue water 3 |
| Water (%) | 2 | 8 | none | 10 |
| Inlet temperature (° C.) | 40 | 22 | 40 | 22 |
| Noodle plasticity | medium very soft and sticky | high | medium very soft and sticky | high |
| Passes | 2+ | 1 | 2+ | 1 |
| Slug-Appearance-Binding | soft tends to break (poorly bound) poor | hard very plastic good | soft tends to break (poorly bound) poor | hard very plastic good |

What is claimed is:

1. A detergent material comprising:

a) a synthetic detergent comprising at least one fatty isethionate foaming surfactant; and b) a hydrophobic plasticizer having a softening point from ambient temperature to 90° C.;

wherein the amount of said synthetic detergent is from 55 to 80 wt. %, and the amount of said hydrophobic plasticizer is from 20 to 45 wt. % relative to the total combined weight of a and b, in substantially homogeneous dispersion and having a weight average particle size of from 50 μm to 1200 μm, in free flowing non-dusting particulate form.

2. The detergent material as claimed in claim 1, wherein the weight average particle size is from 150 μm to 1200 μm.

3. The detergent material as claimed in claim 1, wherein the weight average particle size is from 50 μm to 250 μm.

4. The detergent material as claimed in claim 1, wherein the weight average particle size is from 200 μm to 750 μm.

5. The material as claimed in claim 1, wherein the synthetic detergent further comprises one or more anionic suffactants selected from the group consisting of alkyl sulphates, alkyl sulphonates, alkyl ether sulphates, alkyl glycerol ether suiphonates, alkyl phosphate esters, ethoxylated alkyl phosphate esters, sarcosinates, taurate derivatives, alkyl sulphoacetates, hydroxy alkyl sulphonate esters, alkyl sulphosuccinates, alkyl ether sulphosuccinates, alkyl sulphosuccinamates, and acyl glutamates.

6. The material as claimed in claim 1, wherein the synthetic detergent further comprises at least one sulphosuccinate salt.

7. The material as claimed in claim 1, wherein the synthetic detergent further comprises one or more non-ionic surfactants selected from the group consisting of alkyl polysaccharides, sorbitan ester alkoxylates, glucamide surfactants, alcohol alkoxylate surfactants, and carboxylic acid ethoxylates.

8. The material as claimed in claim 1, wherein the hydrophobic plasticiser is selected from the group consisting of one or more $C_{12}$ to $C_{22}$ fatty acids, $C_{14}$ to $C_{22}$ fatty alcohols, paraffin wax, hydrogenated castor oil, and jojoba wax.

9. The material as claimed in claim 1, which further comprises a filler.

10. A method of making bars of synthetic detergent materials comprising forming a synthetic detergent material in particulate form as claimed in claim 1.

11. A personal care synthetic detergent cleansing bar product that has been made from a synthetic detergent material in particulate form as claimed in claim 1.

12. A detergent material comprising:

a) a synthetic detergent comprising at least one fatty isethionate foaming surfactant; and b) a hydrophobic plasticizer selected from the group consisting of $C_{12}$ to $C_{22}$ fatty acid, $C_{1,}$ to $C_{22}$ fatty alcohol, paraffin wax, hydrogenated castor oil and jojoba wax;

wherein the amount of said synthetic detergent is from 55 to 80 wt. %, and the amount of said hydrophobic plasticizer is from 20 to 45 wt. % relative to the total combined weight of a and b, present in substantially homogeneous dispersion and having a weight average particle size of from 50 $\mu$m to 250 $\mu$m, in free flowing non-dusting particulate form.

13. The material as claimed in claim 12, wherein the synthetic detergent further comprises at least one sulphosuccinate salt.

14. The detergent material as claimed in claim 12, further comprising a filler.

15. A method of making bars of synthetic detergent materials comprising forming a synthetic detergent material in particulate form as claimed in claim 12.

16. A personal care synthetic detergent cleansing bar product that has been made from a synthetic detergent material in particulate form as claimed in claim 12.

17. A detergent material comprising:

a) a synthetic detergent selected from the group consisting of alkyl sulphates, alkyl sulphonates, alkyl ether sulphates, alkyl glycerol ether sulphonates, alkyl phosphate esters, ethoxylated alkyl phosphate esters, sarcosinates, taurate derivatives, alkyl sulphoacetates, hydroxy alkyl sulphonate esters, alkyl sulphosuccinates, alkyl ether sulphosuccinates, alkyl sulphosuccinamates, and acyl glutamates; and b) a hydrophobic plasticizer having a softening point from ambient temperature to 90° C.;

wherein the amount of said synthetic detergent is from 55 to 80 wt. %, and the amount of said hydrophobic plasticizer is from 20 to 45 wt. % relative to the total combined weight of a and b, present in substantially homogeneous dispersion and having a weight average particle size of from 200 $\mu$m to 750 $\mu$m, in free flowing non-dusting particulate form.

18. The material as claimed in claim 17, which further comprises a filler.

19. A method of making bars of synthetic detergent materials comprising forming a synthetic detergent material in particulate form as claimed in claim 17.

20. A personal care synthetic detergent cleansing bar product that has been made from a synthetic detergent material in particulate form as claimed in claim 17.

* * * * *